United States Patent [19]

Bruce

[11] 4,105,503

[45] Aug. 8, 1978

[54] METHOD AND APPARATUS FOR EMISSION CONTROL OF BY-PRODUCT COKE OVENS

[75] Inventor: John McNicol Bruce, Chesterfield, England

[73] Assignee: British Steel Corporation (Chemicals) Limited, Great Britain

[21] Appl. No.: 709,722

[22] Filed: Jul. 29, 1976

[30] Foreign Application Priority Data

Aug. 8, 1975 [GB] United Kingdom ..... 33138/75

[51] Int. Cl.[2] ..... C10B 27/04

[52] U.S. Cl. ..... 201/40; 202/255; 202/257; 202/258; 202/263

[58] Field of Search ..... 202/262, 263, 254, 255, 202/256, 257, 258, 261, 270; 201/40, 41

[56] References Cited

U.S. PATENT DOCUMENTS

| | | | |
|---|---|---|---|
| 2,066,704 | 1/1937 | Still | 202/254 X |
| 2,975,109 | 3/1961 | Van Ackeren | 202/255 X |
| 3,623,959 | 11/1971 | Knappstein | 202/263 X |
| 3,647,053 | 3/1972 | Palumbo | 201/40 X |
| 3,968,014 | 7/1976 | Armour | 202/263 |

FOREIGN PATENT DOCUMENTS

| | | | |
|---|---|---|---|
| 719,861 | 2/1932 | France | 202/263 |
| 1,105,380 | 4/1961 | Fed. Rep. of Germany | 202/263 |

*Primary Examiner*—Morris O. Wolk
*Assistant Examiner*—Arnold Turk
*Attorney, Agent, or Firm*—Bacon & Thomas

[57] ABSTRACT

Control of emission from coke ovens during charging. A bank of coke ovens is provided with two gas mains. The first of the gas mains is connected to each of the individual ovens in turn during charging. The second of the gas mains is connected to the bank of ovens during coking. A fluid energized venturi ejector maintains a predetermined level of vacuum at the head of each individual coke oven during charging. Means are provided to automatically reduce the suction provided by the ejector if the level of vacuum exceeds said limit. This means consists of a valve operated by changes in the level of vacuum at the head of the individual oven during charging. The valve connects the second main to the first, thus increasing the gas pressure applied at the throat of the venturi ejector in turn decreasing the degree of vacuum provided by the venturi ejector. The energy for the ejector may be provided by flushing liquor or by a compressible fluid such as steam, air or an inert gas.

11 Claims, 1 Drawing Figure

METHOD AND APPARATUS FOR EMISSION CONTROL OF BY-PRODUCT COKE OVENS

BACKGROUND OF THE DISCLOSURE

Figure 1:
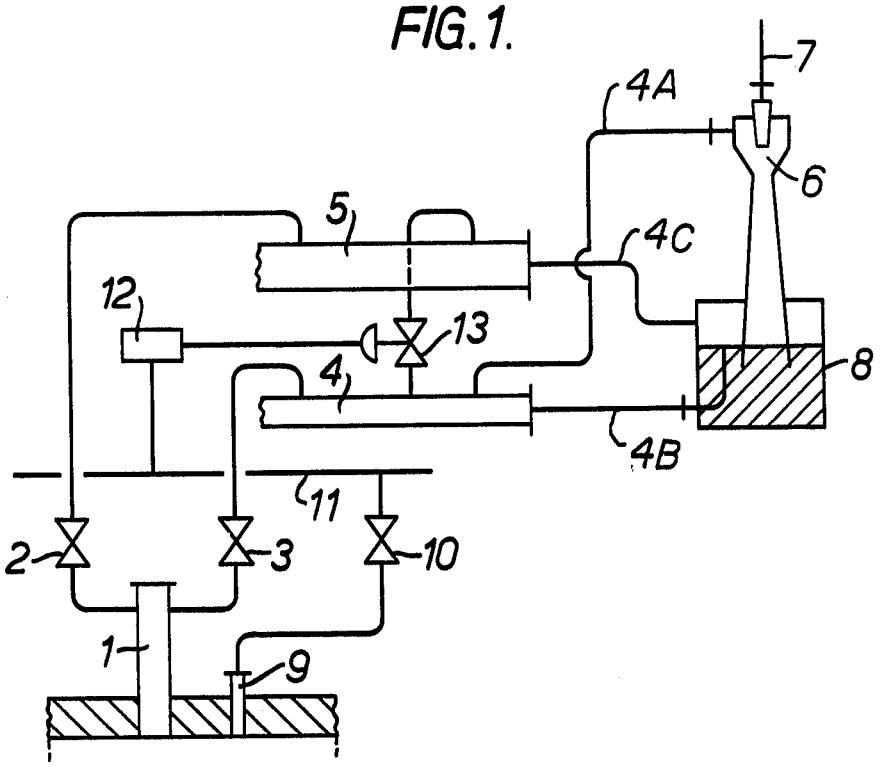

A prolific source of atmospheric pollution associated with the operation of coke ovens is the gas, smoke and particulate matter which is displaced or escapes from the oven through one or more of the charge holes during the charging operation.

One method of controlling this emission is to apply suction to the oven from the associated gas collecting main and a steam jet positioned in the upper part of the gas ascension pipe has commonly been used for this purpose. This method is both costly and inefficient since the steam used is simply expanded to increase its velocity and convey gas into the collecting main by mixing and conservation of momentum, no attempt being made to re-convert the kinetic energy of the combined steam/gas stream to pressure energy as in the orthodox steam ejector. Furthermore the steam used for this purpose must be removed from the gas stream and its condensation places an increased load on the primary coolers.

SUMMARY OF THE INVENTION

A desirable feature of a gas eduction system is that it should maintain pressure in the oven top slightly below atmospheric to prevent polluting emissions but not so far below atmospheric as to induce too much air.

The known systems of steam eduction are not susceptible to accurate control and are operated with the steam supply full on. In accordance with the present invention, a fluid energised venturi ejector is used to maintain a negative pressure, or vacuum, within predetermined limits, at the head of a coke oven during charging of the coke oven, the regulation of said negative pressure being effected automatically, by controlled gas loading of the ejector.

Preferably gas loading is controlled by a valve which responds to changes in pressure at the head of the oven during charging and, when that pressure falls below a predetermined level, the valve operates to connect a source of pressurised gas to the throat of the venturi ejector to decrease the degree of vacuum provided by the ejector. Also preferably two such mains are used together with the fluid energised ejector, the first gas main being connected to the oven during charging and the second gas main being connected to other coke ovens and providing said source of pressurized gas.

The recently introduced practice of charging coal to coke ovens in a dry and preheated condition has given rise to severe carry over of fine coal particles into the hydraulic main during charging, this coal appearing as an unwanted component of the coal tar by-product. One method of dealing with this carry over is to connect the oven to a separate charging main during the charging operation and to the normal hydraulic main thereafter, the tar and liquor collected during charging being separated from the total make.

The above mentioned coal carry-over into the gas main is not fully removed from the gas stream by the normal flushing liquor sprays and unacceptably high concentrations of coal are found in the secondary tar, i.e. tar which separates in the primary coolers, in the tar drained from the gas exhauster, in the tar from the electrostatic detarrers and even further down the by-product process stream. The use of the liquor energised ejector set in which highly turbulent conditions obtain and an efficient regime of gas/liquor/solid interfacial contact will operate, will improve the separation of coal from the gas stream and prevent its being carried forward to the down stream sections of the by-product recovery plant. In other words, if flushing liquor is used as the fluid for the venturi ejector a further advantage is obtained in that the ejector creates highly turbulent conditions in the flushing liquor which would assist in separating coal from the gas stream as the mixture of liquor and coal dust travels down the charging main.

Preferably two such mains are used together with the fluid energised ejector.

Thus the invention also comprises a bank of coke ovens with two gas mains, the first of the gas mains being adapted to be connected to each of the individual ovens in turn during charging and the second of the gas mains being connected to the bank of ovens during coking, a fluid energised venturi ejector being adapted to maintain a predetermined level of vacuum at the head of each individual coke oven during charging and means being provided to automatically reduce the suction provided by the ejector if the level of vacuum exceeds said limit.

In the accompanying drawing:

FIG. 1 illustrates a single coke oven, which may be one of a batch of coke ovens, embodying the invention. In FIG. 1 is shown an ascension pipe 1 serving a single oven which can be connected alternatively by means of valves 2 or 3 to gas mains 4 or 5. Gas main 5 is the normal hydraulic main in which gas from the oven is sprayed with flushing liquor and conducted to a by-product plant. Gas main 4 is a special charging main to which the oven is connected during the operation of charging.

An orthodox fluid energised venturi ejector 6 is supplied with medium pressure flushing liquor through the line 7, the gases educted from the main 4 being separated from the flushing liquor in a separator 8. A pressure connection 9 in the oven top is connectable through valve 10 to a manifold 11 serving a pressure controller 12. Valve 13 actuated on an impulse from controller 12 connects gas mains 4 and 5 in a variable manner. A single powerful ejector 6 is used to control oven top pressure in a battery of ovens.

The operation of the system is as follows. During the charging operation the oven is connected to the charging main 4 by opening valve 3 and closing valve 2. Valve 10 is open when valve 3 is open and these valves i.e. 2, 3 and 10 may desirably be interlocked or ganged. Flushing liquor is supplied continuously to the ejector nozzle box and suction is applied to the main 4 through the line 4A and thus to the oven top. The flushing liquor is separated from the gas it has entrained from main 4 in separator 8 and together with any tar which has condensed is fed back to the charging main through the line 4B. The gas separated in 8 is passed to the normal hydraulic main through the line 4C.

Regulation of oven top pressure is effected by controlled gas loading of the ejector 6 in the following manner. The supply of flushing liquor to the ejector is fully on at all times. The pressure controller 12 is set to hold the oven top pressure at a predetermined level e.g. — 1 inch water gauge.

Should the oven pressure fail below this set point, the valve 13, opening on the output from controller 12, will allow gas from hydraulic main 5 to pass into the charging main increasing the gas loading on the ejector and reducing suction at the oven top.

Conversely an increase in gas evolution from the oven or excessive air induction caused by oven top sealing failure or otherwise will result in closure of valve 13, the full capacity of the ejector being available to handle the greater gas load and control oven top pressure.

The system is capable of dealing with inadvertent removal of a second charge hole lid during single oven sequential charging thus overcoming the so-called 'flute' effect in a manner not possible with known ascension pipe steam jets.

The pressure condition in the normal hydraulic main is at all times controlled by the orthodox Askania valve and exhauster system and will not fall below atmospheric if in the limiting case valve 3 is closed, no gas is being made into main 4 and the ejector is pulling its full load through valve 13 and recycling it to main 5.

If the oven shown in the drawing is, as is usual, one of a bank of ovens, each oven will be provided with a set of valves 2, 3 and 10, but there will be a single controller 12 for all of the ovens and a single ejector will serve the whole bank. Ejector 6 will be run continuously when charging, although it may be possible to shut off the ejector in between the charging of successive ovens.

By using this invention, instead of controlling suction at the oven top by varying the amount of liquor supply to the ejector 6, the capacity of the ejector is varied whilst maintaining a fixed supply of liquor. Thus the suction of the oven head is controlled by recycling gas and by varying the capacity of the ejector to create suction.

Summarising the operation:

During the charging of an oven, valves 3 and 10 are open and valve 2 is closed. Controller 12 is set to maintain say — 1 inch water gauge. If the pressure at the oven top falls below this level, controller 12 operates to open valve 13 so as to allow gas from the hydraulic main 5 to pass into the charging main 4. This increases the gas loading on the ejector, thus reducing vacuum at the oven top. The supply of quenching liquor to the ejector 6, is kept fully on all the time but varying the loading of the ejector enables suction to be controlled. During coking, valve 2 is open but valves 3 and 10 are closed. Thus the oven top is connected via valve 2 to the normal hydraulic main 5.

The main 5 is operated in the normal way during coking by an Askania valve between the ovens and the turbo-driven exhaust. The Askania valve ensures a pressure slightly above atmospheric in the hydraulic main.

It is important to note that the take-off point on the main 5 to valve 13 must always be at the top of the main as shown. The special charging main 4 will always be at a lower pressure than the hydraulic main 5 so that there is always suction from main 5 into main 4 when valve 13 is open.

Although this invention has been described, merely by way of example, in terms of a liquor energised ejector, the invention is not limited to the use of liquor. Energy for gas ejection may be provided equally well by steam or by other compressible fluid such as air or inert gas. In the latter cases the separator 8 will be of different design or may in some configuration be omitted.

We claim:

1. A method for controlling emissions from a coke oven during the charging of the oven wherein a hydraulic main is connected to the head of the coke oven during coking, comprising disconnecting the hydraulic main from the oven prior to charging the oven and connecting the head of the oven to a fluid energized venturi ejector to draw a vacuum at the head of the oven and withdraw emissions therefrom, maintaining the supply of energizing fluid to the ejector substantially constant, sensing the degree of vacuum at the head of the oven during charging and introducing gases from a source of gases under higher pressure into the withdrawn emissions in response to an increase in the level of sensed vacuum above a predetermined level to thereby gas load the ejector and decrease the degree of vacuum drawn at the head of the oven being charged.

2. A method according to claim 1 in which coke oven gases under pressure in the hydraulic main are used to supply the gases for gas loading the ejector.

3. A method according to claim 1 in which the fluid used to energize the ejector is a compressible fluid.

4. A method according to claim 1 in which emissions from a bank of coke ovens are controlled, some of the ovens being connected to the hydraulic main and providing gases under pressure while another oven is being charged and is connected to said venturi ejector.

5. A method according to claim 1 in which fluid employed to energize the ejector is normal flushing liquor.

6. A method according to claim 5 in which gases are separated from the flushing fluid after passing through the ejector and are introduced into the hydraulic main.

7. In an apparatus comprising a bank of coke ovens provided with first and second gas mains, a system for controlling emissions from the ovens during charging comprising means for connecting each of the individual ovens in turn to the first of the gas mains during charging and for disconnecting said ovens from said first gas main during coking, means for connecting each of the individual ovens to the second of said gas mains during coking and for disconnecting said ovens from the second of said gas means during charging, a fluid energized venturi ejector, means connecting said ejector to said first gas main to thereby withdraw emissions and maintain a vacuum at the head of the coke oven being charged, means for sensing the degree of vacuum at the head of the coke oven being charged, and means responsive to an increase in the degree of vacuum sensed by said sensing means for automatically gas loading the ejector to thereby reduce the suction provided by the ejector and reduce the degree of vacuum at the head of the oven being charged to thereby maintain said vacuum within predetermined limits.

8. Apparatus according to claim 7 including means connecting said two gas mains and in which said means responsive to an increase in the degree of vacuum comprises a valve in the means connecting said two gas mains, said valve being operated by changes in the level of vacuum at the head of the individual oven during charging to open when the level of vacuum is greater than a predetermined limit thus connecting the second of the gas mains to the first and permitting flow of gases from the second of the gas mains into the first to gas load the ejector.

9. Apparatus according to claim 7 wherein said second gas main is the hydraulic collector main for the bank of coke ovens.

10. Apparatus according to claim 9 including means for supplying flushing fluid to the ejector for energizing said ejector.

11. Apparatus according to claim 10 including means for separating gases from the flushing fluid after passage through the ejector and for returning such gases to the hydraulic main.

* * * * *